US007550923B2

(12) United States Patent
Creusot et al.

(10) Patent No.: US 7,550,923 B2
(45) Date of Patent: Jun. 23, 2009

(54) PLASMA PANEL FACEPLATE COMPRISING UV RADIATION RE-SCATTERING MEANS

(75) Inventors: Jean-Pierre Creusot, Eybens (FR); Yvan Raverdy, Bernin (FR)

(73) Assignee: Thomson Licensing, Boulogne-Billancourt (FR)

( * ) Notice: Subject to any disclaimer, the term of this patent is extended or adjusted under 35 U.S.C. 154(b) by 77 days.

(21) Appl. No.: 10/493,668

(22) PCT Filed: Oct. 21, 2002

(86) PCT No.: PCT/FR02/03587

§ 371 (c)(1),
(2), (4) Date: Dec. 7, 2004

(87) PCT Pub. No.: WO03/038853

PCT Pub. Date: May 8, 2003

(65) Prior Publication Data

US 2005/0077825 A1 Apr. 14, 2005

(30) Foreign Application Priority Data

Oct. 29, 2001 (FR) ..... 01 13954

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS 4,542,317 A 9/1985 Morimoto et al. ..... 313/496
6,010,973 A * 1/2000 Watanabe et al. ..... 501/20
6,013,309 A * 1/2000 Kim et al. ..... 427/68
6,159,066 A * 12/2000 Amatsu et al. ..... 445/24
6,215,246 B1 * 4/2001 Kim et al. ..... 313/584
6,353,287 B1 * 3/2002 Sasaki et al. ..... 313/582
6,788,373 B2 * 9/2004 Ito et al. ..... 349/122

FOREIGN PATENT DOCUMENTS

EP 1085554 3/2001

(Continued)

OTHER PUBLICATIONS

Database WPI, Section Ch, Week 199911, Derwent Publn. Ltd., London, AN 1999-127334 & JP 11-003665 (Matsushita Denki Sangyo KK) Jan. 6, 1999.

(Continued)

*Primary Examiner*—Nimeshkumar D. Patel
*Assistant Examiner*—Anne M Hines
(74) *Attorney, Agent, or Firm*—Robert D. Shedd; Harvey D. Fried; Patricia Verlangieri

(57) ABSTRACT

The invention relates to a faceplate including a dielectric layer and a protection layer. According to the invention, in order to re-scatter the UV radiation, the interface between the dielectric layer and the protection layer is structured such that it has an average roughness, which is included in the wavelength domain of said radiation, of between 130 and 20 nm in particular. Such re-scattering means are significantly more economical and effective than previous means. The aforementioned roughness can be obtained by performing an abrasion operation on the surface of the dielectric layer.

8 Claims, 1 Drawing Sheet

FOREIGN PATENT DOCUMENTS

| | | | |
|---|---|---|---|
| JP | 11-003665 | | 1/1999 |
| JP | 11-260254 | | 9/1999 |
| JP | 2000011897 A | * | 1/2000 |
| WO | 98/43270 | | 1/1998 |

OTHER PUBLICATIONS

Patent Abstracts of Japan, vol. 1999, No. 14, Dec. 22, 1999 and JP 11-260254 (Dainippon Printing Co. Ltd.), Sep. 24, 1999.
Search report dated Feb. 12, 2003.

* cited by examiner

PLASMA PANEL FACEPLATE COMPRISING UV RADIATION RE-SCATTERING MEANS

This application claims the benefit, under 35 U.S.C. § 365 of International Application PCT/FR02/03587, filed Oct. 21, 2002, which was published in accordance with PCT Article 21(2) on May 8, 2003 in French and which claims the benefit of French patent application No. 0113954, filed Oct. 29, 2001.

Figure 1:
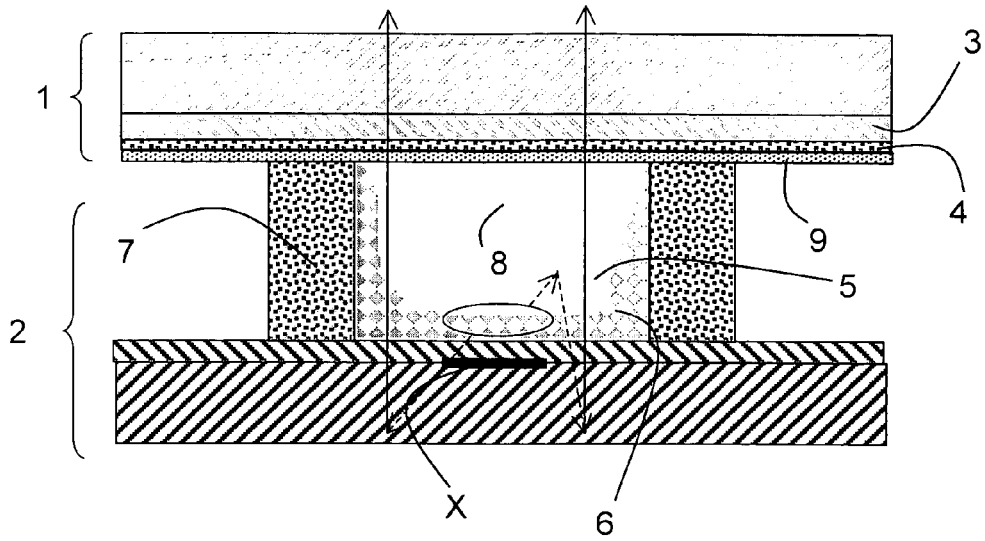

The invention relates to a plasma display comprising, with reference to FIG. 1:

- a first panel 1 comprising at least a first array Y of electrodes (not shown) that is coated with a dielectric layer 3 and with a protective and secondary-electron-emitting layer 4,
- a second array Y' of electrodes (not shown),
- a second panel 2 leaving between it and the first panel a space containing a discharge gas, said space being divided into a two-dimensional matrix of discharge regions 5,
- each discharge region 5 being positioned between the electrodes of the first array and those of the second array and having walls partly covered with a layer 6 of a phosphor suitable for emitting visible light when excited by the radiation from a discharge in this region and
- the first panel comprising means for backscattering the discharge radiation onto the phosphors of the corresponding regions, in this case a scattering layer 9.

The second array of electrodes is generally placed on the first panel in such a way that, in operation, most of the discharges arise between two electrodes of the same panel and are termed coplanar electrodes. Neither of the two arrays of coplanar electrodes Y, Y' has been shown in FIG. 1 because this represents a cross section made in a plane passing between these electrodes. In general, the second panel includes a third array X of electrodes that serves for addressing or activating the discharge regions of the display before what are called the sustain periods.

The dielectric layer 3 is designed to achieve a memory effect so as to be able, after activation of a discharge region, to sustain a succession of discharges by applying suitable voltage pulses between the electrodes of the first array Y and those of the second array Y'.

The protective and secondary-electron-emitting layer 4 is used to protect the dielectric layer from bombardment by the ions coming from the discharge plasma and is also capable of emitting electrons under the action of this ion bombardment so as to stabilize the operation of the display.

It is the first panel 1 that is generally transparent to the radiation emitted by the phosphors and that then forms the front image display panel; the second panel is therefore the rear panel, which is generally covered with phosphors in each of the discharge regions.

The discharge regions of the display are, in general and at least in part, bounded by barrier ribs 7, which form walls for the discharge regions 5 and serve in general as means of keeping the panels apart; in each discharge region, the phosphors 6 are generally applied both to the rear panel and to the sides of the barrier ribs.

Owing to the nature and the pressure of the gas generally contained in the space between the panels, the plasma discharges 8 emit ultraviolet radiation, indicated in FIG. 1 by the dotted lines.

As shown in the left-hand part of the discharge 8, a first portion of this ultraviolet radiation is emitted toward the rear panel 2 and the sides of the ribs 7 and is therefore directly adsorbed by the phosphors 6 deposited at that place; the phosphors are then excited and emit visible radiation that passes through the front panel 2 and thus contributes to the formation of the image to be displayed: the visible radiation is indicated in the figure by the solid lines.

As shown in the right-hand part of the discharge 8, a second portion of this ultraviolet radiation is emitted toward the front panel 1; because of the scattering means with which the front panel is provided, and which will be described later, this radiation is backscattered, at least partly, into the space between the panels, especially toward the phosphors 6 so as to be converted into visible radiation like the first portion of the ultraviolet radiation.

It is therefore apparent that the scattering means with which the front panel is provided allows a larger portion of the radiation emitted by the discharges to be converted and substantially increases the luminescence efficiency of the display.

Document EP 1 085 554 teaches how to increase the luminescence efficiency of plasma displays:

- either by using an ultraviolet radiation reflection layer, according to the documents cited in paragraph 4 in the above document; this layer is preferably inserted between the dielectric layer and the protective and secondary-electron-emitting layer;
- or, as shown in FIG. 1, by using a scattering layer 9, deposited on the protective layer and having a particle size suitable for obtaining the scattering effect within the wavelength range corresponding to ultraviolet radiation.

The drawback with the methods for improving the luminescence efficiency that are described in these documents is that they require an additional layer, for reflection or scattering, to be added to the front panel; this additional layer adds an additional interface or dioptic system along the path of the visible light rays passing through the front panel, which impairs transmission of the visible radiation and lessens the improvements in luminescence efficiency provided by this additional layer.

Even in the most favorable case, described as a variant in document EP 1 085 554, in which the scattering layer has a composition close to that of the protective layer, for example based on MgO, the process described in that document for obtaining it is difficult to implement effectively; to achieve the particle size providing the scattering effect, that document teaches depositing it in an aqueous phase, which is prejudicial to the performance of the protective and secondary-electron-emitting layer, especially to its cathode emission properties under ion bombardment, which are essential for operating stability and lifetime of the plasma display.

The object of the invention is to improve the luminescence efficiency of plasma displays while avoiding these drawbacks.

For this purpose, the subject of the invention is a panel intended to form part of a plasma display and comprising at least a first array of electrodes that is coated with a dielectric layer and with a protective and secondary-electron-emitting layer,

- said plasma display comprising at least a second array of electrodes and a second panel leaving between it and the first panel a space containing a discharge gas,
- the electrodes of the first array and those of the second array being arranged so as to leave discharge regions between them and between the panels, and the walls of these regions being partly covered with a layer of a phosphor suitable for emitting light when excited by the radiation from discharges emitted between the electrodes in these regions, characterized in that the interface between the dielectric layer and the protective and secondary-electron-emitting layer is structured so as to have a mean roughness lying within the range of the wavelengths of said discharge radiation and/or of the light emitted by said phosphor, especially if this phosphor is a phosphor emitting in the ultraviolet.

The subject of the invention is also a panel intended to form part of a plasma display and comprising at least one array of electrodes that is coated with a dielectric layer and with a protective and secondary-electron-emitting layer, characterized in that the interface between the dielectric layer and the protective layer is structured so as to have a mean roughness of between 130 nm and 400 nm, and preferably between 130 and 200 nm.

Owing to the structure of this interface, a large portion of the radiation that is not directly adsorbed and converted by the phosphors is backscattered toward these phosphors and contributes to their excitation; thus, the luminescence efficiency of the display is significantly improved, at least to a level similar to that of the displays described in the abovementioned document EP 1 085 554; one advantage of this arrangement is that it is much easier to obtain than the scattering or reflection layers described in the prior art, without any risk of impairing the performance of the protective and secondary-electron-emitting layer.

Thus, the panel according to the invention includes means for backscattering the discharge radiation toward the phosphors; in general, this panel is not coated with phosphors, although such an arrangement is not excluded.

The mean roughness of the structured interface according to the invention may be evaluated by using a conventional roughness meter based on an electromagnetic probe.

Since the protective and secondary-electron-emitting layer is very thin, it generally has the same structure as that of the structured interface according to the invention, so that it is therefore possible to measure the roughness of the interface on the surface of the protective layer.

The range of wavelengths of the discharge radiation corresponds to the spectral range comprising more than 90% of the energy emitted by the discharges.

In most plasma displays, the discharge gas is based on a neon/xenon mixture and the discharges in the displays emit ultraviolet radiation, having two main emission peaks, one at 145 nm and the other at 175 nm; thus, since the wavelength range of the discharge radiation lies within the ultraviolet, the mean roughness of said interface is preferably between 130 and 200 nm.

Preferably, the protective and secondary-electron-emitting layer is based on oxides of alkaline earth elements, especially based on magnesia (MgO).

Preferably, the dielectric layer is based on a glassy inorganic material.

The subject of the invention is also a plasma display comprising a panel according to the invention and a second panel leaving between it and the first panel a space containing a discharge gas, which also includes a second array of electrodes, the electrodes of the first array and those of the second array being arranged so as to leave discharge regions between them and between the panels, and the walls of these regions being partly covered with a layer of phosphor suitable for emitting visible light when excited by the radiation from the discharges emitted between the electrodes in these regions.

Preferably, the first panel according to the invention is the front panel of the display; the term "front panel" is understood to mean that one located on the same side as the person observing the images displayed by the display; the electrodes placed on this panel are in general transparent. Because the interface between the dielectric layer and the protective layer is structured according to the invention to backscatter only the radiation emitted by the discharges between the panels, it absorbs none or very little of the visible light emitted by the phosphors; this front panel is therefore advantageously transparent to the visible light emitted by the phosphors; it is more transparent to this light since there are fewer interfaces or dioptic systems to pass through than in the panels of the prior art that also have discharge-radiation backscattering or reflection means.

The subject of the invention is also a process that can be used to manufacture a plasma display panel according to the invention, comprising the deposition of a dielectric layer on at least one array of electrodes on this panel and the deposition of a protective and secondary-electron-emitting layer on the dielectric layer, characterized in that before said protective layer is deposited, but after the dielectric layer has been deposited, a suitable abrasion operation is carried out on the surface of the dielectric layer so that the mean roughness of this surface is within the range of wavelengths of the discharge radiation in the plasma display, in particular so that it is between 130 and 400 nm, preferably between 130 and 200 nm.

Such a process is particularly simple and economical; it is preferably applicable if the dielectric layer is based on a glassy inorganic material, that is to say based on enamel; such an enamel layer is generally obtained by depositing a layer based on a dielectric enamel frit followed by this being baked under conditions suitable for obtaining a dense layer having a smooth surface; the abrasion operation on this surface is then carried out just after the enamel-baking step; this abrasion operation modifies the surface roughness of the enamel; next, the protective layer, generally based on MgO, is deposited in a conventional manner; as this protective layer is very thin, the layer obtained generally has the same roughness as the surface of the enamel layer.

Preferably, the abrasion operation on the surface of the dielectric layer is carried out by friction of a plastic encrusted with abrasive powder against this surface; this is a method commonly used for polishing or lapping glass surfaces or metallographic specimens; the plastic is preferably a polishing felt, for example based on rigid polyurethane foam, having open pores on the surface, that can contain or retain abrasive powder particles; plastic pastes incorporating the abrasive powder may also be used.

When the aim is to have a mean roughness between 130 and 200 nm, the particle diameter of the abrasive powder is preferably between 0.2 and 2 μm; this is in practice the size of the abrasive particles suitable for obtaining a dielectric layer surface having a mean roughness between 130 and 200 nm.

Preferably, the abrasion operation is carried out dry or in a liquid medium containing no water; a special felt encrusted with abrasive powder particles is then used.

By carrying out the operation in the absence of water, any deterioration of the dielectric layer is thus avoided and the correct cathode emission performance of the protective layer is more easily guaranteed, thereby improving the lifetime of the display.

Figure 2:
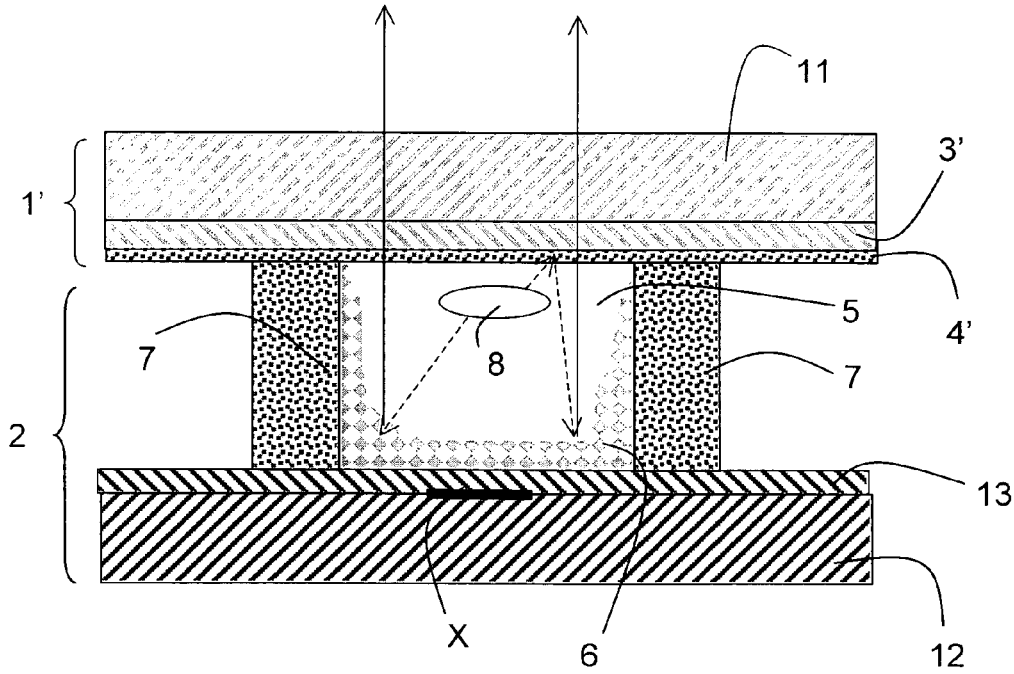

The invention will be more clearly understood on reading the description that follows, given by way of non-limiting example and with reference to the appended figures, in which:

FIG. 1, already described, is a schematic sectional representation of a plasma display cell of the prior art; and FIG. 2 illustrates, in the same representation, a preferred embodiment of the invention applied to the same type of cell.

To simplify the description and bring out the differences and advantages afforded by the invention compared to the prior art, identical references will be used for those elements that fulfil the same functions.

The description starts, with reference to FIG. 2, with a preferred example of the process for obtaining a plasma display with a high luminescence efficiency according to the invention, in the case in which this display is of the AC type with memory effect; this display comprises a transparent front panel 1' with pairs of coplanar electrodes and a rear panel 2.

The manufacture of the front panel 1' will firstly be described.

Deposited conventionally on a soda-lime glass plate with the dimensions of the display to be produced are two arrays Y, Y' of parallel coplanar and interspersed electrodes in such a way that each electrode of the first array is adjacent an electrode of the second array; each pair of electrodes thus formed therefore corresponds to a row of pixels of the display; each electrode is, for example, formed from a narrow opaque bus for distributing the discharge current and from a transparent conducting strip, for example made of ITO (indium tin oxide) deposited along the bus and in contact therewith; in this case, electrodes of one and the same pair face each other via one side of their respective transparent strip.

Next, a paste based on a dielectric enamel frit is prepared, this being deposited on the arrays of electrodes as a layer of uniform thickness over the entire active surface of the panel; according to a variant, only the electrodes of the arrays Y, Y' may be covered; apart from this enamel frit, the above paste contains a polymer-based organic binder and, in general, a solvent for this binder; after deposition, drying, in order to evaporate the solvent, and where appropriate crosslinking of the organic binder, the enamel layer is baked in order to remove the organic binder from the layer and to vitrify the enamel so as to obtain a uniform dielectric enamel layer 3'; after baking, the layer obtained has a smooth and plane surface which, in this state, would allow the radiation emanating from the discharges to pass through it; the thickness of the dielectric layer is generally between 10 and 50 μm.

The next step is specific to the invention: it consists in modifying the surface finish of the dielectric layer in order to give this surface the ability to scatter the ultraviolet radiation that the discharges will emit, especially between the electrodes of the arrays Y, Y' in the display when operating.

For this purpose, an abrasion operation is carried out on this surface so as to obtain a dielectric surface that is no longer smooth as previously, but one having a mean roughness lying within the range of the wavelengths of the radiation that will be emitted by the discharges in the display during operation; conventionally, this range is that of ultraviolet radiation and this operation is carried out so as to give the dielectric surface a mean roughness of between 130 and 200 nm; this mean roughness is, for example, measured using a roughness meter with an electromagnetic head, such as an instrument of the DEKTAK brand.

To carry out this abrasion operation, many known methods may be used such as, for example, mechanical lapping using a very fine abrasion powder.

After baking, the surface of the enamel lends itself better to a mechanical lapping operation using a very fine abrasive; it is preferred to use commercially available abrasives with particle sizes between 0.2 μm and 2 μm, either as pastes (diamond, alumina, carborundum), or on a felt for dry polishing; more precisely, one of the following methods may for example be carried out:

- lapping in a liquid medium with a diamond paste, using a lubricant, preferably one that is inert and chemically inactive with respect to the enamel layer; it is preferred to use a heavy alcohol, for example of the isopropanol type, compatible with the paste containing the diamond-based abrasive powder; it is advantageous to avoid the use of water so as to better guarantee the properties of the MgO-based protective layer to be deposited on the lapped surface;
- dry lapping using a special felt containing the abrasive powder, for example of the "glass paper" type; by thus avoiding the use of water, the properties of the MgO-based protective layer to be deposited on the lapped surface are advantageously preserved.

To improve the efficiency and the uniformity of this mechanical lapping operation, it is preferred to use suitable machines that impart a complex movement to the felt holder or slurry holder ("satellites") on the surface to be lapped; this type of machine is widely used for lapping or polishing glass surfaces.

Without departing from the invention, other mechanical abrasion methods may be used, such as blasting the surface with a carrier gas containing abrasive powder (or "sandblasting"); it is also possible to use chemical abrasion methods, electroerosion methods and chemical-mechanical methods well known to those skilled in the art of surface treatments.

After this abrasion operation specific to the invention, the dielectric layer now has a "structured" surface:

- which will no longer allow the radiation coming from the discharges through it, but will backscatter said radiation toward the interior of the display and
- which, like the smooth and plane starting surface, will, however, allow through the visible radiation emitted by the phosphors deposited on the rear panel, of which mention will be made later.

After this abrasion operation, a protective and secondary-electron-emitting layer 4', in this case based on MgO, is deposited in a manner known per se, for example by vacuum evaporation; the thickness of the layer obtained is generally between 0.5 and 1.5 μm.

Since the layer obtained is very thin, it is found that the roughness and the structure of the surface of the dielectric layer is related to the external surface of the protective and secondary-electron-emitting layer.

Using the abovementioned conventional abrasion methods, it is found that the structure of the surface of the dielectric layer 3' at the interface with the protective layer 4' is of the "spatial noise" type, like the structure of the protective layer itself; such structure is different than that of the scattering layers described in the abovementioned document EP 1 085 554 that are obtained by precipitation in an aqueous medium.

The front panel 1' according to the invention is capable of backscattering the ultraviolet radiation but of allowing the visible radiation through, thanks to the structure of the interface between the dielectric layer 3' and the protective layer 4', this structure being suitable for giving a mean roughness lying within the range of wavelengths of the discharge radiation, especially between 130 and 200 nm; such backscattering means are much more economical and effective than those of the prior art because such a roughness may be obtained by a simple abrasion operation. In addition, because there is no operation to deposit an additional layer specifically for reflecting or backscattering the UV, the panel obtained has a much higher mechanical strength.

With regard to the rear panel 2 of the display according to the invention, this is produced in a manner known per se for obtaining a panel comprising, on a soda-lime glass plate 12:

a third array X of electrodes that extends perpendicular to the direction of the electrodes of the arrays Y, Y' on the front panel;

an enamel-based dielectric layer 13;

an array of barrier ribs 7 suitable for defining the discharge regions and such that said discharge regions are, after the panels have been joined together, positioned at the intersection of the electrodes of the array X and of the pairs of interspersed electrodes of the arrays Y, Y' of the first panel; and phosphor layers 6 deposited on the walls of the discharge regions thus defined, that is to say both on the bottom of these regions in contact with the dielectric layer 13 and on the sides of the ribs 7.

Next, the front panel 1' is joined to the rear panel 2 so that the electrodes of the array X of the rear panel 2 intersect the pairs of electrodes of the arrays Y, Y' of the front panel 1' between the ribs 7; the ribs 7 then serve as means of keeping the panels 1', 2 spaced apart.

The two panels are sealed together in a manner known per se, the gas contained in the space between the panels 1' and 2 is pumped out and this space filled with a discharge gas, generally comprising xenon.

The plasma display according to the invention is then obtained; the structure, specific to the invention, of the surface of the dielectric layer 3' at the interface with the protective layer 4' allows a substantial portion of the radiation not directly absorbed and converted by the phosphors to be recovered, so it can be backscattered toward these phosphors; thus, the luminous efficiency of the display is significantly improved, to a level at least similar to that of the displays described in the aforementioned document EP 1 085 554, while avoiding a specific scattering or reflection layer in the front panel of the display; advantageously, thanks to the invention, the MgO-based protective layer may be very easily shielded from any trace of water, thereby better ensuring the cathode emission properties of this layer and the lifetime of the display.

The invention claimed is:

1. A plasma display including a first panel comprising:

at least a first array of electrodes that is coated with a dielectric layer and with a protective and secondary-electron-emitting layer, said plasma display comprising at least a second array of electrodes and a second panel leaving between it and the first panel a space containing a discharge gas, the electrodes of the first array and those of the second array being arranged so as to leave discharge regions between them and between the panels, and the walls of these regions being partly covered with a layer of a phosphor suitable for emitting light when excited by the radiation from the discharges emitted between the electrodes in these regions, wherein the interface between the dielectric layer and the protective and secondary-electron-emitting layer is structured so as to have a mean roughness greater than 200 nm and less than 400 nm, said structure and roughness being transferred to the external surface of the protective and secondary-electron-emitting layer and being located in order to backscatter the discharge radiation toward the phosphors.

2. The panel as claimed in claim 1, wherein the protective and secondary-electron-emitting layer is based on oxides of alkaline earth elements.

3. The panel as claimed in claim 2, wherein the dielectric layer is based on a glassy inorganic material.

4. A process that can be used to manufacture a plasma display panel as claimed in claim 1, comprising the deposition of a dielectric layer on at least one array of electrodes on this first panel and the deposition of a protective and secondary-electron-emitting layer on the dielectric layer, wherein before said protective layer is deposited, but after the dielectric layer has been deposited, a suitable abrasion operation is carried out on the surface of the dielectric layer so that the mean roughness of this surface is greater than 200 nm and less than 400 nm.

5. The process as claimed in claim 4, wherein the abrasion operation on said surface is carried out by friction of a plastic encrusted with abrasion powder against said surface.

6. The process as claimed in claim 5, wherein the particle diameter of the abrasive powder is between 0.2 and 2 μm.

7. The process as claimed in claim 5, wherein the abrasion operation is carried out dry.

8. The process as claimed in claim 5, wherein the abrasion operation is carried out in a liquid medium containing no water.

* * * * *